US011434703B2

(12) United States Patent
Propes et al.

(10) Patent No.: US 11,434,703 B2
(45) Date of Patent: Sep. 6, 2022

(54) HYBRID DRILL BIT COMPENSATED GAUGE CONFIGURATION

(71) Applicant: HALLIBURTON ENERGY SERVICES, INC., Houston, TX (US)

(72) Inventors: Christopher Charles Propes, Montgomery, TX (US); Gregory Christopher Grosz, Magnolia, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 12 days.

(21) Appl. No.: 16/972,502

(22) PCT Filed: Jun. 29, 2018

(86) PCT No.: PCT/US2018/040434
§ 371 (c)(1),
(2) Date: Dec. 4, 2020

(87) PCT Pub. No.: WO2020/005292
PCT Pub. Date: Jan. 2, 2020

(65) Prior Publication Data
US 2021/0270094 A1 Sep. 2, 2021

(51) Int. Cl.
*E21B 7/06* (2006.01)
*E21B 17/10* (2006.01)

(52) U.S. Cl.
CPC ..... *E21B 17/1092* (2013.01); *E21B 7/064* (2013.01)

(58) Field of Classification Search
CPC ... E21B 7/064; E21B 7/06; E21B 7/04; E21B 17/1092
See application file for complete search history.

(56) References Cited

U.S. PATENT DOCUMENTS 6,142,250 A 11/2000 Griffin et al.
7,971,662 B2 * 7/2011 Beuershausen ..... E21B 10/20 175/408

(Continued)

OTHER PUBLICATIONS

Korean Intellectual Property Office, International Search Report and Written Opinion, PCT/US2018/040434, dated Mar. 29, 2019, 14 pages, Korea.

*Primary Examiner* — Taras P Bemko
(74) *Attorney, Agent, or Firm* — Haynes and Boone, LLP

(57) ABSTRACT

A rotary drill bit includes movable gauge elements biased to protrude radially through a circumferential engagement surface of a gauge pad. The gauge elements are retractable to protrude a lesser distance against the bias of a biasing mechanism. Fluid chambers are defined adjacent the gauge elements, and fluid is permitted to be bled into and out of the fluid chambers to delay and slow the retraction and extension of the gauge elements. During straight drilling operations, the biasing mechanisms maintain the gauge elements in an extended position providing stability to the drill bit. When a steering force is applied to the drill bit, the gauge elements retract slowly as fluid is bled from the fluid chambers. As the gauge elements rotate with the drill bit, the retracted configuration may be maintained as gauge elements disengage the geologic formation on a side of the drill bit opposite the steering direction.

20 Claims, 6 Drawing Sheets

(56) References Cited

U.S. PATENT DOCUMENTS

| | | | | |
|---|---|---|---|---|
| 8,763,726 | B2 * | 7/2014 | Johnson | E21B 7/06 175/266 |
| 2009/0044979 | A1 | 2/2009 | Johnson et al. | |
| 2009/0188720 | A1 * | 7/2009 | Johnson | E21B 7/06 175/76 |
| 2011/0147089 | A1 * | 6/2011 | Kulkarni | E21B 10/62 76/108.4 |
| 2012/0255788 | A1 | 10/2012 | Schwefe et al. | |
| 2015/0152723 | A1 | 6/2015 | Hay | |
| 2015/0292268 | A1 | 10/2015 | Oesterberg | |
| 2016/0032658 | A1 | 2/2016 | Jain | |

* cited by examiner

HYBRID DRILL BIT COMPENSATED GAUGE CONFIGURATION

CROSS-REFERENCE TO RELATED APPLICATIONS

This application is a U.S. national stage patent application of International Patent Application No. PCT/US2018/040434, filed on Jun. 29, 2018, the benefit of which is claimed and the disclosure of which is incorporated herein by reference in its entirety.

BACKGROUND

Various types of downhole drilling tools including, but not limited to, rotary drill bits, reamers, and core bits, have been used to form wellbores in associated geologic formations, e.g., for forming oil and gas wells. Examples of rotary drill bits that may be used in downhole drilling include, but are not limited to, fixed cutter drill bits, drag bits, polycrystalline diamond compact (PDC) drill bits, and matrix drill bits.

Drill bits generally include a plurality of cutting elements thereon, which mechanically scrape the geologic formations surrounding wellbores, causing pieces of rock to separate from the geologic formations. The cutting elements may be provided on leading faces of the drill bit that engage the bottom surface of the wellbore to extend the borehole along a trajectory. Drill bits often also include gauge pads on circumferential surfaces of the drill bit that engage a circumferential sidewall of the borehole. Gauge pads may include a plurality of gauge elements that have some, little or no cutting capability, but enhance drill bit stability during both linear and non-linear drilling. By enhancing the drill bit stability, any inclination for unintended side cutting by the drill bit is reduced, resulting in fewer ledges formed in the circumferential sidewall of the wellbore, which could otherwise frustrate the installation of casing or other equipment in the wellbore.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is directed to a rotary drill bit including movable gauge elements extending through a circumferential engagement surface of a gauge pad. The gauge elements are biased to protrude radially from the circumferential engagement surface to define the "full gage" of the drill bit, and retractable to become flush with the circumferential engagement surface if the gauge pad. Fluid chambers are defined behind the gauge elements, and fluid is permitted to pass into and out of the fluid chambers to delay and slow the movement of the gauge elements. During straight drilling operations, biasing mechanisms maintain the gauge elements in an extended configuration to provide stability to the drill bit. During steering operations, a steering force is applied to the drill bit and reaction forces from the geologic formation cause the gauge elements to retract against the bias of the biasing mechanisms on a side of the drill bit in engagement with the formation. As the gauge elements rotate to an opposite side of the drill bit, the retracted configuration of the gauge elements is maintained due to the fluid chambers. The gauge elements reengage the geologic formation in a retracted configuration such that it is not necessary to again expend energy to overcome the bias of the biasing mechanism. Even if the gauge elements move only to a partially retracted position and maintain engagement with the geologic formation around a full rotation of the drill bit, energy savings are still realized. The gauge elements may be arranged to provide uniform engagement forces, or may be arranged to provide a decreasing engagement force according to an axial position on the drill bit. The fluid chambers may be fluidly isolated from one another, or the fluid chambers on a particular blade of the drill bit may all be in fluid communication with one another.

Figure 1:
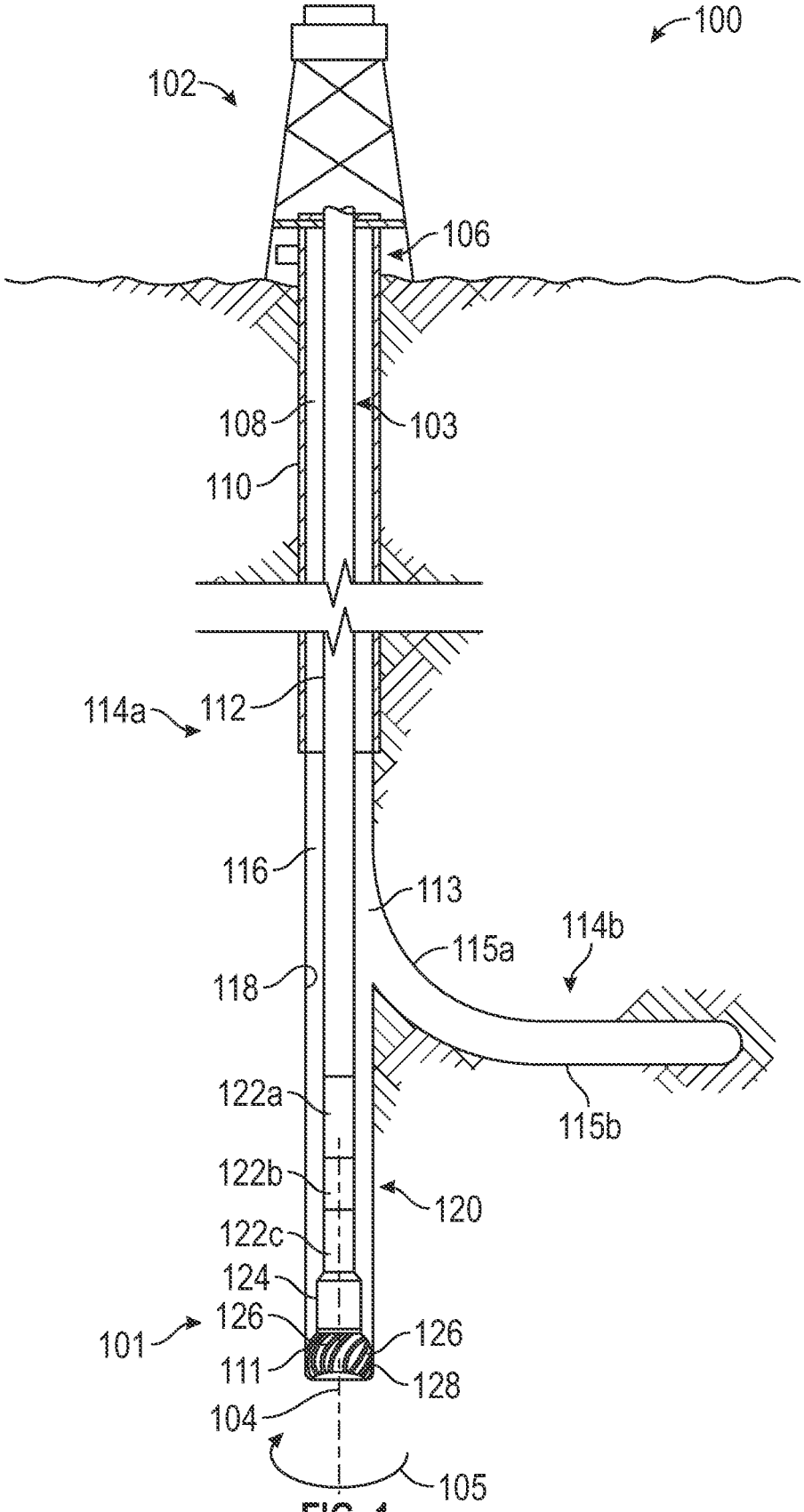
FIG. 1 is an elevation view of a drilling system including a rotary drill bit for drilling a wellbore in accordance with some embodiments of the present disclosure.

FIG. 1 is an elevation view of a drilling system 100 including a rotary drill bit 101 for drilling wellbores 114*a*, 114*b* (generally or collectively wellbore 114) in accordance with some embodiments of the present disclosure. Drilling system 100 may include a well site at a surface location 106. Various types of drilling equipment such as a rotary table, drilling fluid pumps and drilling fluid tanks (not expressly shown) may be located at the surface location 106. For example, a drilling rig 102 may be provided with various features associated with terrestrial drilling operations with a "land drilling rig." However, teachings of the present disclosure may be satisfactorily applied in offshore drilling operations, e.g., operations with drilling equipment located on offshore platforms, drill ships, semi-submersibles and drilling barges (not expressly shown).

Drilling system 100 may also include a drill string 103 associated with the drill bit 101 for forming a wide variety of wellbores 114 such as generally vertical wellbore 114*a*, generally horizontal wellbore 114*b*, and/or wellbores having any other orientation. Various directional drilling techniques and associated components of a bottom hole assembly (BHA) 120 coupled within the drill string 103 may be used to form deviated wellbores such as the horizontal wellbore 114*b*. For example, lateral forces may be applied to BHA 120 proximate kickoff location 113 to steer the drill bit 101 and form a curved portion 115*a* and a generally straight portion 115*b* of the generally horizontal wellbore 114*b*. The term "directional drilling" may be used to describe drilling a wellbore or portions of a wellbore that extend at a desired angle or angles relative to vertical. The desired angles may be greater than normal variations associated with vertical wellbores. Directional drilling may also be described as drilling any wellbore deviated from vertical.

BHA 120 may include a wide variety of components configured to form wellbore 114. For example, the BHA 120 may include the drill bit 101, and components 122*a*, 122*b* and 122*c* (generally or collectively components 122) coupled in the drill string 103 above the drill bit 101. The components 122 of the BHA 120 may include, but are not limited to, drill collars, rotary steering tools, directional drilling tools, downhole drilling motors, reamers, hole enlargers, stabilizers etc. The number and types of components 122 included in BHA 120 may depend on anticipated downhole drilling conditions and the type of wellbore 114 that will be formed by drill string 103 and rotary drill bit 101. BHA 120 may also include various types of well logging tools (not expressly shown) and other downhole tools associated with directional drilling of a wellbore. Examples of logging tools and/or directional drilling tools may include, but are not limited to, acoustic, neutron, gamma ray, density, photoelectric, nuclear magnetic resonance, rotary steering tools and/or any other commercially available well tool. Further, BHA 120 may also include a rotary drive (not expressly shown) connected to components 122 that rotates at least part of drill string 103, e.g., parts of the drill string including the drill bit 101 and the components 122.

Wellbore 114 may be defined in part by casing string 110 that may extend from surface location 106 to a selected downhole location. Portions of wellbore 114 illustrated in FIG. 1 that do not include casing string 110 may be described as "open hole." Various types of drilling fluid, or "mud," may be pumped from the surface location 106 through drill string 103. The drilling fluids may be expelled from the drill string 103 through nozzles (depicted as nozzles 156 in FIG. 2) passing through rotary drill bit 101. The drilling fluid may be circulated back to surface location 106 through an annulus 108, 116 defined between an outside diameter 112 of the drill string 103 and a surrounding structure. For example, an open hole annulus 116 is defined between the drill string 103 and an inside diameter 118 of the wellbore 114*a*. The inside diameter 118 may be referred to as the "sidewall" or a circumferential wall of the wellbore 114*a*. A cased annulus 108 may also be defined between the drill string 103 and the casing string 110.

The drill bit 101, discussed in further detail below, may include one or more blades 126, with respective junk slots or fluid flow paths 140 (FIG. 2) disposed there between. The blades 126 may project or extend outwardly from exterior portions of a rotary bit body 124. Drill bit 101 may rotate with respect to bit rotational axis 104 in a direction defined by directional arrow 105. One or more cutting elements 128 may be disposed outwardly from exterior portions of each blade 126, and at least some of the blades 126 may also include gauge pads 111 defined on circumferential surfaces thereof. The drill bit 101 may be designed and formed in accordance with teachings of the present disclosure and may have many different designs, configurations, and/or dimensions according to the particular application of drill bit 101.

Figure 2:
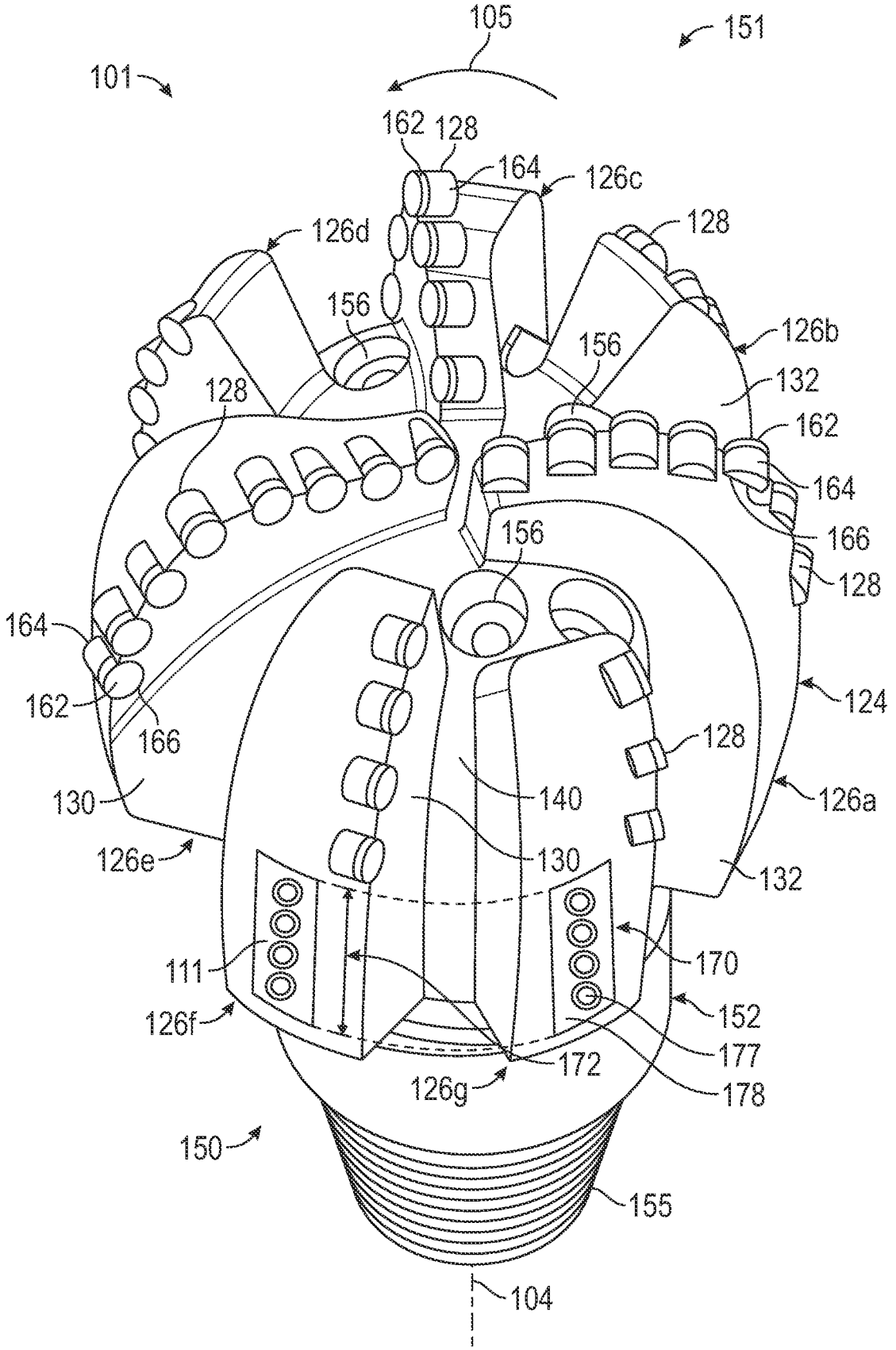
FIG. 2 is a perspective view of the drill bit of FIG. 1 illustrating a plurality of cutting elements and gauge pads disposed on a bit body of the rotary drill bit.

FIG. 2 is a perspective view of the drill bit 101 of FIG. 1 illustrating a plurality of fixed cutting elements 128 and gauge pads 111 disposed on the bit body 124. Although drill bit 101 is illustrated generally as a fixed cutter drill bit 101, in other embodiments, drill bit 101 may be any of various other types of rotary drill bits, including, roller cone drill bits, coring bits, polycrystalline diamond compact (PDC) drill bits, drag bits, matrix drill bits, and/or steel body drill bits operable to form a wellbore (e.g., wellbore 114 as illustrated in FIG. 1) extending through one or more downhole formations.

Drill bit 101 defines a leading end 151 that generally arranged for physical contact with the geologic formation and a trailing end 150 for coupling the drill bit 101 to a drill string 130 (FIG. 1). At the leading end 151, drill bit 101 may include one or more blades 126 (e.g., blades 126*a*-126*g*) that define exterior portions of the bit body 124. Blades 126 define junk slots 140 therebetween, and may be any suitable type of projections extending radially outwardly from a rotational axis 104. Blades 126 may have a wide variety of configurations including, but not limited to, substantially arched, generally helical, spiraling, tapered, converging, diverging, symmetrical, and/or asymmetrical. Each of the blades 126 may have respective leading surfaces 130 in the direction of rotation of the drill bit 101 and trailing surfaces 132 located opposite leading surfaces 130. In some embodiments, blades 126 may be positioned along bit body 124 such that they have a spiral configuration relative to bit rotational axis 104. In other embodiments, blades 126 may be positioned along bit body 124 in a generally parallel configuration with respect to each other and bit rotational axis 104. Cutting elements 128

Cutting elements 128 are generally arranged along the leading surfaces 130 of the blades 126 and may include various types of cutters, compacts, buttons, inserts, and gauge cutters satisfactory for use with a wide variety of drill bits 101. Cutting elements 128 may include respective substrates 164 with a layer of hard cutting material (e.g., cutting table 162) disposed on one end of each respective substrate 164. The substrates 164 of the cutting elements 128 may be constructed materials such as tungsten carbide, and the hard layer 162 of cutting elements 128 be constructed of materials including polycrystalline diamond (PCD) materials. The hard layer 162 may provide a cutting surface that engages adjacent portions of a downhole formation to form wellbore 114 (FIG. 1). Blades 126 may include recesses or bit pockets 166 that may be configured to receive cutting elements 128. For example, bit pockets 166 may be concave cutouts on blades 126.

Blades 126 include the gauge pads 111 disposed on radially outer circumferential surfaces 170 of the blades 126. The gauge pads 111 may include abrasion resistant materials such as tungsten carbide and PCD materials, and may be arranged to contact a geologic formation tangentially such that the gauge pads perform little or no cutting of the geologic formation. In some embodiments, portions of the gauge pads 111 may be angled scrape against a geologic formation to perform a significant cutting function. The gauge pads 111 may extend from the bit rotational axis 104 a radial distance slightly greater or slightly smaller than a radial distance cut by cutting elements 128. The gauge pads 111 may define radially outermost surfaces of the drill bit 101 along an axial gauge pad region 172 wherein the gauge pads 111 are located.

The gauge pads 111 include a plurality of movable gauge elements 177 spaced from one another along a direction of the bit rotation axis 104. The gauge elements 177 are biased to extend a greater radial distance from the bit rotational axis 104 than a circumferential engagement surface 178 of the gauge pads 111, and may be retractable into the bit body 124 to be flush with the circumferential engagement surface 178. Thus the gauge elements 177 may define radially outermost surfaces of the drill bit 101 along the axial gauge pad region 172 when the gauge elements 177 are extended, and the gauge elements 177 together with the engagement surfaces 178 may define the radially outermost surfaces when the gauge elements are retracted. In some embodiments, the engagement surfaces 178 include an abrasion resistant plate material distinct from the bit body 124, and in other embodiments, the engagement surfaces 178 may be integrally formed with the bit body 124.

The trailing end 150 of drill bit 101 may include shank 152 having a drill string connector such as drill pipe threads 155 formed thereon. Threads 155 may releasably engage with corresponding threads (not shown) on BHA 120 (FIG. 1) such that the drill bit 101 may be rotated relative to bit rotational axis 104. Drilling fluids may be communicated from the BHA 120 to the drill bit 101, and the drilling fluids may be expelled through one or more nozzles 156.

Figure 3A:
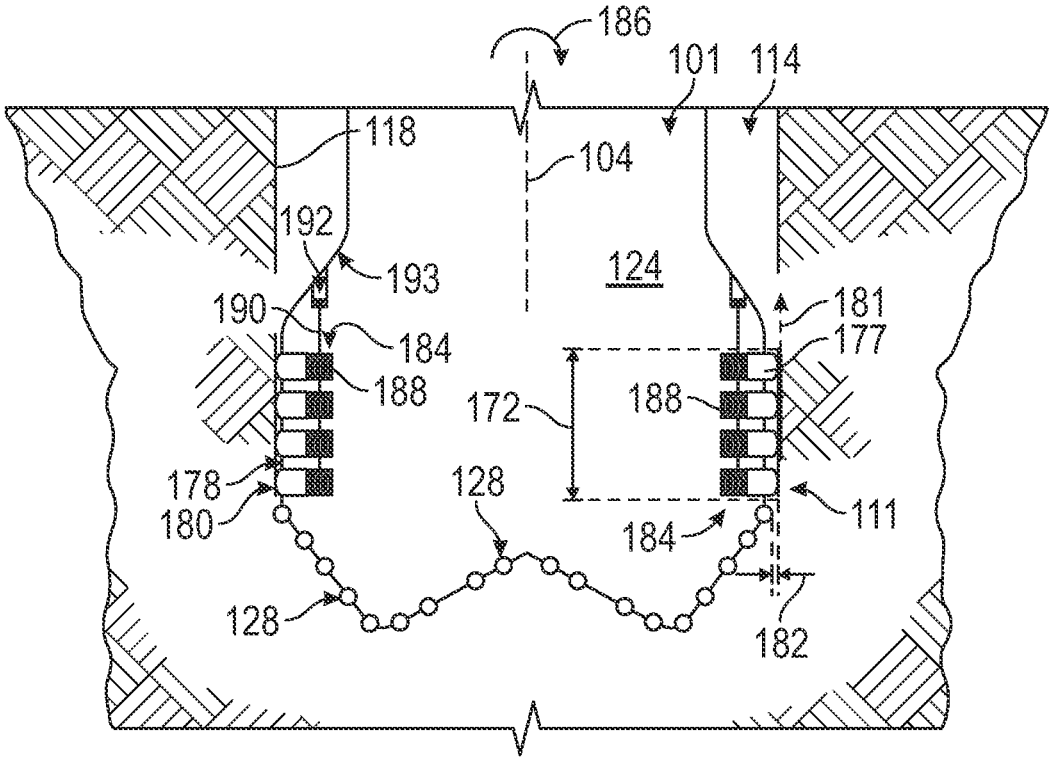
FIG. 3A is a schematic view of the drill bit of FIG. 2 in operation in the wellbore illustrating a plurality of moveable gauge elements extending through a circumferential engagement surface of a gauge pad having a relieved gauge arrangement.

FIG. 3A is a schematic view of the drill bit 101 in operation in the wellbore 114. The moveable gauge elements 177 extend through the circumferential engagement surface 178 to define a relieved gauge arrangement. The movable gauge elements 177 are illustrated in an extended configuration such that radial faces 180 of the movable gauge elements 177 define a radially-outermost surface of the drill bit 101 within the axial gauge pad region 172. As illustrated, when each of the movable gauge elements is in the extended configuration, the radial faces 180 are aligned along an axis 181 generally parallel to the rotational bit axis 104. In other embodiments (not shown) the radial faces 180 may each be arranged to extend a different distance from the rotational bit axis 104. A radial relief distance 182 is defined between the axis 181 of the radial faces 180 and an outermost cutting element 128 or the sidewall 118 of the wellbore 114. In some embodiments, the radial relief distance 182 may be between about 1 mm and about 3 mm.

Each of the movable gauge elements 177 is biased radially outward beyond the engagement surfaces 178 of the gauge pad 111 by an individual biasing mechanism 184. In some embodiments, the individual biasing mechanisms 184 may be a helical compression springs, wave springs, stacks of Bellville washers (see FIG. 6B), resilient elastomeric members or other recognized biasing mechanisms. The biasing mechanisms 184 each exert an individual biasing force to the respective gauge element 177, with which the gauge element engages the formation in operation. In some embodiments, the biasing mechanisms 184 provide the same engagement force to the respective gauge elements 177, and in some embodiments, the biasing elements 184 provide a variable or decreasing engagement force to the respective gauge elements 177 along an axial direction of the bit body 124. The variation in engagement force may be provided by selection and/or arrangement of the biasing mechanisms 184. For example, a spring rate of each if the biasing mechanisms 184 may be selected to decrease along the axial direction of the drill bit.

The decreasing engagement forces, may permit the gauge elements 177 to effectively provide stability to the drill bit 101 without unduly counteracting a steering force applied to the drill bit 101 from a drill string 103 (FIG. 1). For example, if a steering torque 186 is applied to the drill bit, engagement forces of the gauge elements 177 most distant from the steering torque 186 may be greater than the engagement forces applied by the gauge elements 177 less distant from the steering torque 186. Thus, gauge elements 177 engaging the sidewall 118 on a side opposite the turning direction will more easily permit the drill bit 101 to pivot and change direction.

A fluid chamber 188 is defined behind adjacent each of the gauge elements 177. The fluid chambers 188 have a variable volume depending on the radial distance the adjacent movable gauge element 177 protrudes from the engagement surface 178. When the movable gauge elements 177 are in the extended position (e.g., FIG. 6B) the fluid chambers 188 have a relatively greater volume than when the movable gauge elements are in the retracted position (e.g., FIG. 4). A bleed passageway 190 extends through the bit body 124 between the fluid chambers 188 and a pressure-compensated chamber 192 defined within the bit body. The pressure-compensated chamber 192 may include a pressure compensator therein to limit the pressure differential between a fluid in the pressure-compensated chamber 192 and a fluid on an exterior surface 193 of the drill bit 101 (e.g., drilling fluid or mud). In the embodiment illustrated, the bleed passageway 190 extends through a plurality of the fluid chambers, e.g. each of the fluid chambers defined within a blade 126 (FIG. 2) of the drill bit 101. The fluid chambers 188 are fluidly coupled to one another through the bleed passageway 190.

The bleed passageway 190 is sized to permit the flow of fluid (e.g., drilling fluid or mud) therethrough at a controlled rate. When one of the gauge elements 177 is urged radially inward to the retracted position, the fluid within the adjacent fluid chamber 188 is pressurized and induced to flow out of the fluid chamber 188 through the bleed passageway 190. When the biasing mechanism 184 returns the gauge element 188 to the extended position, fluid may be drawn into the fluid chamber through the bleed passageway 90. This flow of fluid through the bleed passageway 190 may slow the movement of the gauge element 177 such that the gauge element 177 moves between the retracted and extended positions in about 0.5 seconds or more in some embodiments. The time it takes the gauge element 177 to move between the retracted and extended positions may be precisely defined and designed into the drill bit 101 to suit a particular application. In some applications, the gauge element 177 may not move to a fully retracted position, and may maintain contact with sidewall 188 of a borehole around a full revolution of the bit 101 in a partially retracted position.

Figure 3B:
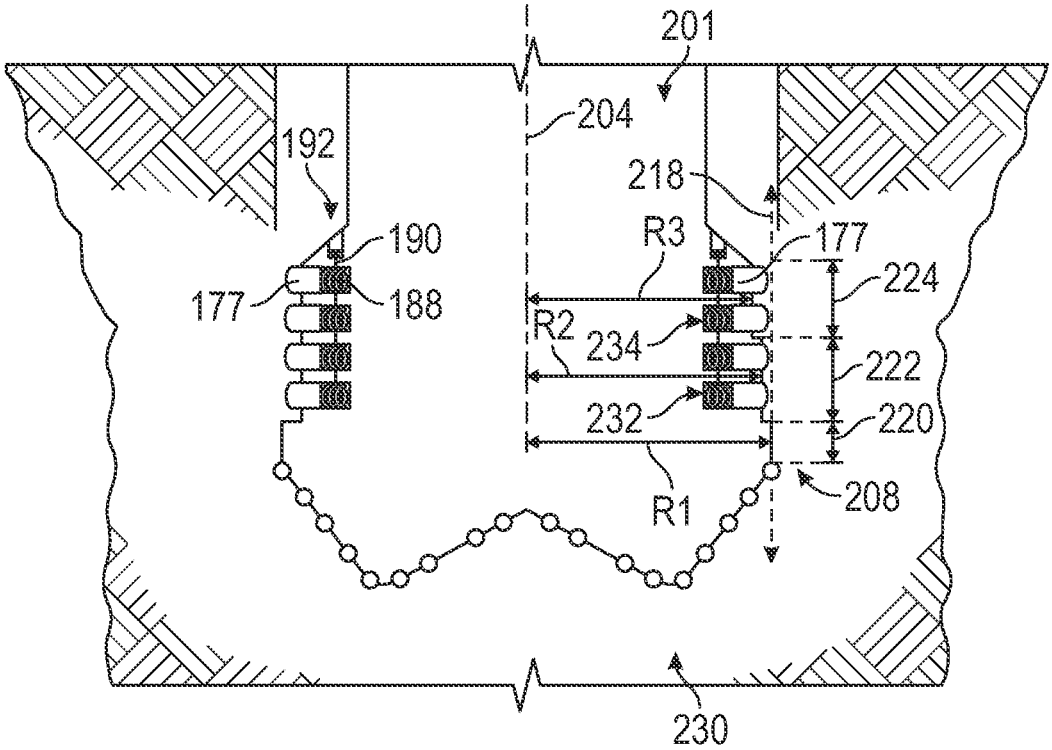
FIG. 3B is a schematic view of a drill bit in operation in the wellbore illustrating a plurality of moveable gauge elements extending through a circumferential engagement surface of a gauge pad.

FIG. 3B is a schematic view of a drill bit 201 in operation in the wellbore 114. The moveable gauge elements 177 extend through a stepped circumferential engagement surface 208 to define a stepped gauge arrangement. In their extended configuration, the radial faces 180 of the movable gauge elements 177 are aligned along an axis 218, which is generally parallel to a rotational bit axis 204 and which extends along a first step 220 of the engagement surface 208. The first step 220 is disposed a first radial distance R1 from the rotational bit axis 204, which is greater than a second radial distance at which a second step 222 is disposed from the rotational bit axis, which is greater than a third radial distance R3 at which a third step 224 is disposed from the rotational bit axis 204. Each of the first, second and third steps 220, 222, 224 of the circumferential engagement surface 208 is disposed successively a greater axial distance from a leading end 230 of the drill bit 201. As illustrated in FIG. 3B, no movable gauge elements 177 extend through the first step 220, a first pair 232 of movable gauge elements 177 extend through the second step 222, and a second pair 234 of movable gauge elements 177 extend through the third step. In a retracted configuration, faces 180 of the first pair 232 of movable gauge elements 177 may be flush with the second step 222 and faces 180 of the second pair 234 may be flush with the third step 224.

In other embodiments (not shown), more or fewer steps may be provided, and more or fewer movable gauge elements 177 may extend through each of the steps. In still other embodiments, a tapered circumferential engagement surface may be provided. The circumferential engagement surface may exhibit any diminishing or reduced profile with respect to a major gage diameter of the drill bit, or may exhibit any variable-diameter profile along an axial length of the drill bit. An axis through the faces 180 of the movable gauge elements 177 may be arranged obliquely with respect to a rotational bit axis in some embodiments.

In the embodiment illustrated in FIG. 3B, the bleed passageway 190 includes a valve 236 disposed therein. The valve 236 may be operable to adjust a flow area through the bleed passageway 190. The valve 236 may be set such thereby induce a predetermined duration for movement of the movable gauge elements 177 between the retracted and extended positions. In some embodiments, the valve 236 may be adjustable in real time from the surface to change a variable diameter orifice extending therethrough. In other embodiments, the valve 236 may include a static orifice having a non-zero diameter predetermined to be suitable for a particular application. When the valve 236 includes a static orifice, the valve 236 may be removable (e.g., by unthreading the valve 236 from the bit body) and replaceable at the surface with a valve 236 having a different diameter if necessary. The duration may depend on variables including characteristics of the fluid, the change in volume of the fluid chambers 188, and a flow area through the bleed passageway 190. By adjusting flow area through the bleed passageway 190, a desired rate of movement of the gauge element 177 may be selected.

Figure 4:
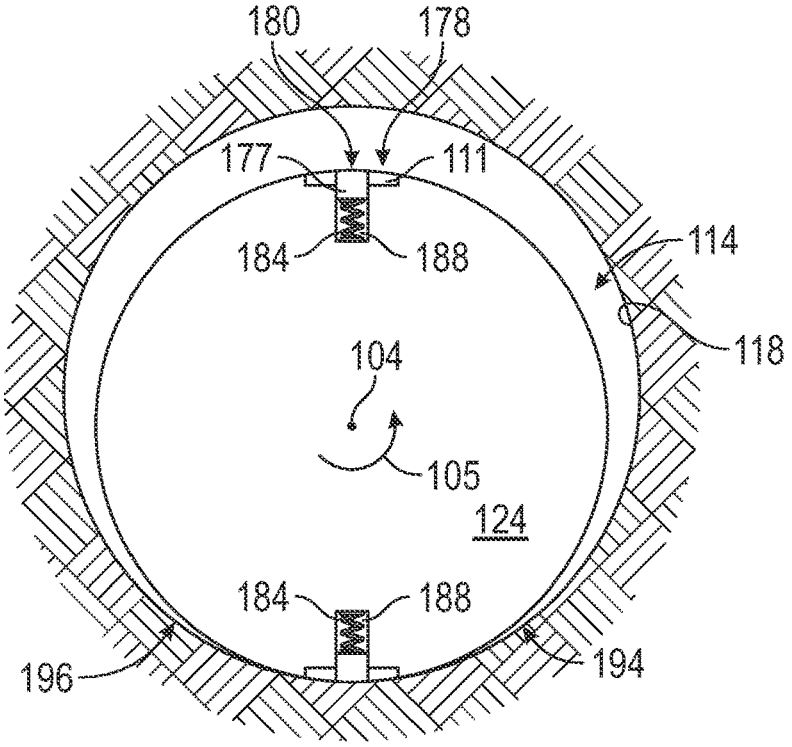
FIG. 4 is a schematic view of the drill bit of FIG. 3A during a steering operation in the wellbore illustrating gauge elements in a retracted configuration, both engaged with the geologic formation on a low side of the drill bit and spaced from the geologic formation on a high side of the drill bit.

FIG. 4 is a schematic view of the drill bit 101 during a steering operation in the wellbore 114. Gauge elements 177 are illustrated in a retracted position, e.g., wherein the face 180 is generally flush with the circumferential engagement surface 178 of a gauge pad 111. A steering force is applied to the drill bit 101 such that the drill bit 101 is urged to one side of the wellbore 114. For example, as illustrated in FIG. 4, the drill bit 101 is urged engage the sidewall 118 on a low side of the drill bit 101 and is spaced from the sidewall 118 on a high side of the drill bit 118. The engagement of the gauge elements 117 with the sidewall 118 on the low side will cause the gauge elements 117 to retract into the bit body 124 within a few revolutions of the drill bit 104 in the direction 105 about the rotational bit axis 104. Once a sufficient volume of fluid is bled from the fluid chamber 188 through the bleed passageway 190 (FIG. 3A), the gauge elements may mover radially inwardly to the retracted position.

As the drill bit 101 rotates, the gauge elements 177 will disengage the sidewall 118 at a disengagement point 194. On the side of the drill bit (e.g., the high side) opposite the turning or steering direction (e.g., toward the low side) the biasing mechanisms 184 urge the movable gauge elements 177 radially outward toward the extended position. However, the flow of fluid into the fluid chamber 188 may delay the movement of the movable gauge elements 177 until the movable gauge elements 177 reach a reengagement point 196 on the sidewall 118. For example, the drill bit 101 may be rotated at a sufficient rate (e.g., 120 RPM) to keep during the duration (e.g., 0.5 seconds) for the movement of the movable gauge elements 177.

Since the gauge elements 177 may remain at least partially retracted, it may not be necessary to expend energy to overcome the bias of the biasing mechanism 184 each revolution of the drill bit 101. When the steering force is removed, the movable gauge elements 177 may return to their extended position under the bias of the biasing mechanism 184. Thereafter, the movable gauge elements 177 may engage the sidewall 188 around a full revolution of the bit 101.

Figure 5:
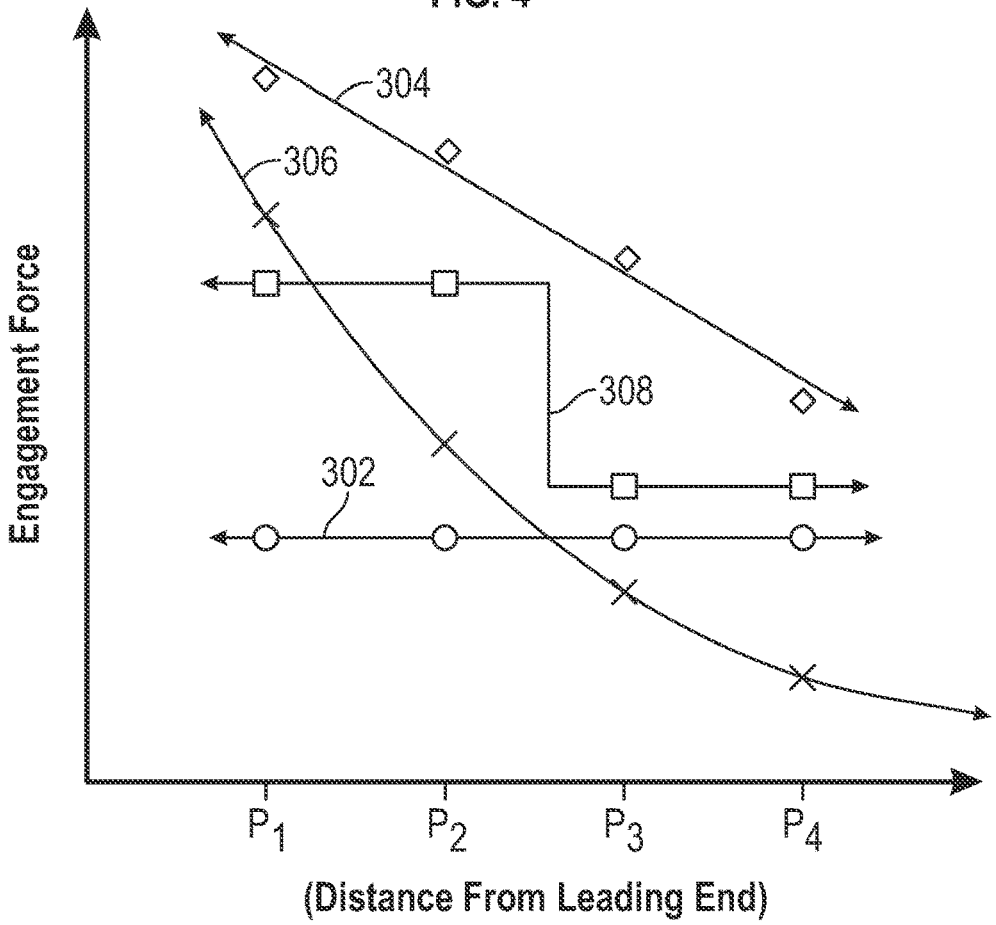
FIG. 5 is a graphical view of an engagement force of the various gauge elements according to an axial position of the gauge elements on the bit body.

FIG. 5 is a graphical representation of the engagement force provided by the movable gauge elements as a function of axial position along the bit body 224 (FIG. 2). Four axial positions P1, P2, P3 and P4 for movable gauge elements 177 (FIG. 3A) are illustrated along the horizontal axis at increasing axial distances from a trailing end 150 of a drill bit 101 (FIG. 2). An engagement force to be provided by a movable gauge element at each of the axial positions P1, P2, P3 and P4 is represented along the vertical axis. In some embodiments, a uniform engagement force may be provided along the axial positions as illustrated by curve 302. In other embodiments, the engagement force may decrease along a generally linear curve 304 or exponential curve 306. In still other embodiments, as illustrated by curve 308, movable gauge elements 177 at adjacent axial positions may provide similar engagement forces, while the overall engagement force decreases along a stepped profile. Each of these arrangements may provide stability to the drill bit 101 in various circumstances without unduly frustrating a steering force applied to the drill bit 101.

Figure 6A:
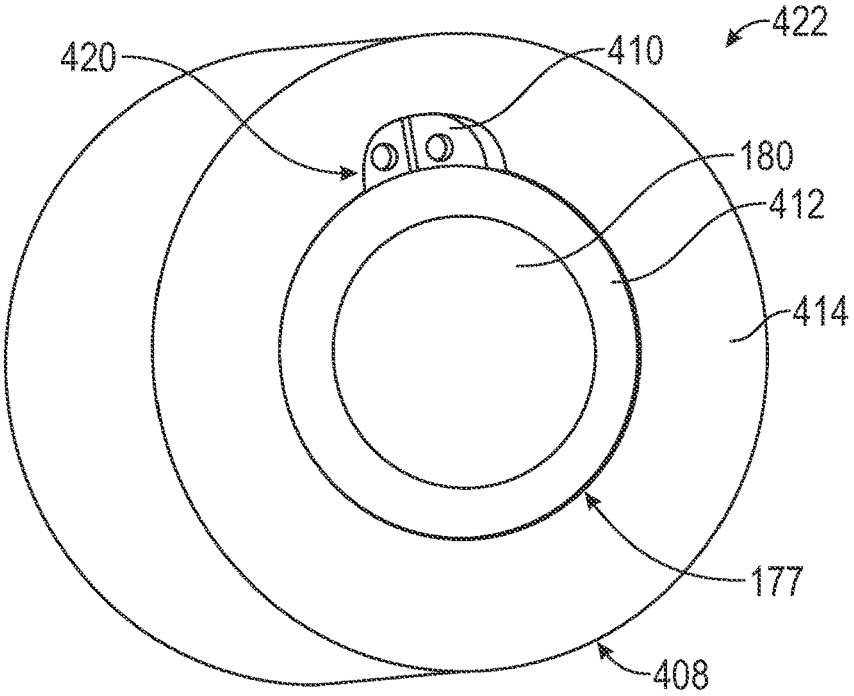
FIG. 6A is a perspective view of one example of one of the gauge elements coupled to a cylinder with a retaining ring to define a gauge pad subassembly.

FIG. 6A is a perspective view of one of the gauge elements 177 coupled to a housing or cylinder 408 with a retaining ring 410. The face 180 of the movable gauge element 177 includes a rounded edge 412, which is blunt and may be arranged to perform little or no cutting of geologic formations. The face 180 may be constructed of PDC or other abrasion resistant materials, and protrudes from a forward end 414 of the cylinder 408. A slot 420 is defined in the forward end 414 to facilitate assembly of the retaining ring 410, which may be a C-ring or similar device. The cylinder 408 may represent a portion the bit body 124 (FIG. 2) and/or may be a separate component that may be coupled to the bit body 124, e.g., by brazing the cylinder 408 into a pocket defined in the bit body 124. Where the cylinder 408 is a separate component, a gauge element subassembly 422 is defined by the cylinder 408, movable gauge element 177, retaining ring 410 a biasing element 184 (FIG. 6B) disposed within the cylinder 408. The gauge element subassembly 422 may be preassembled to provide a particular engagement force to facilitate construction of a drill bit 101 (FIG. 2).

Figure 6B:
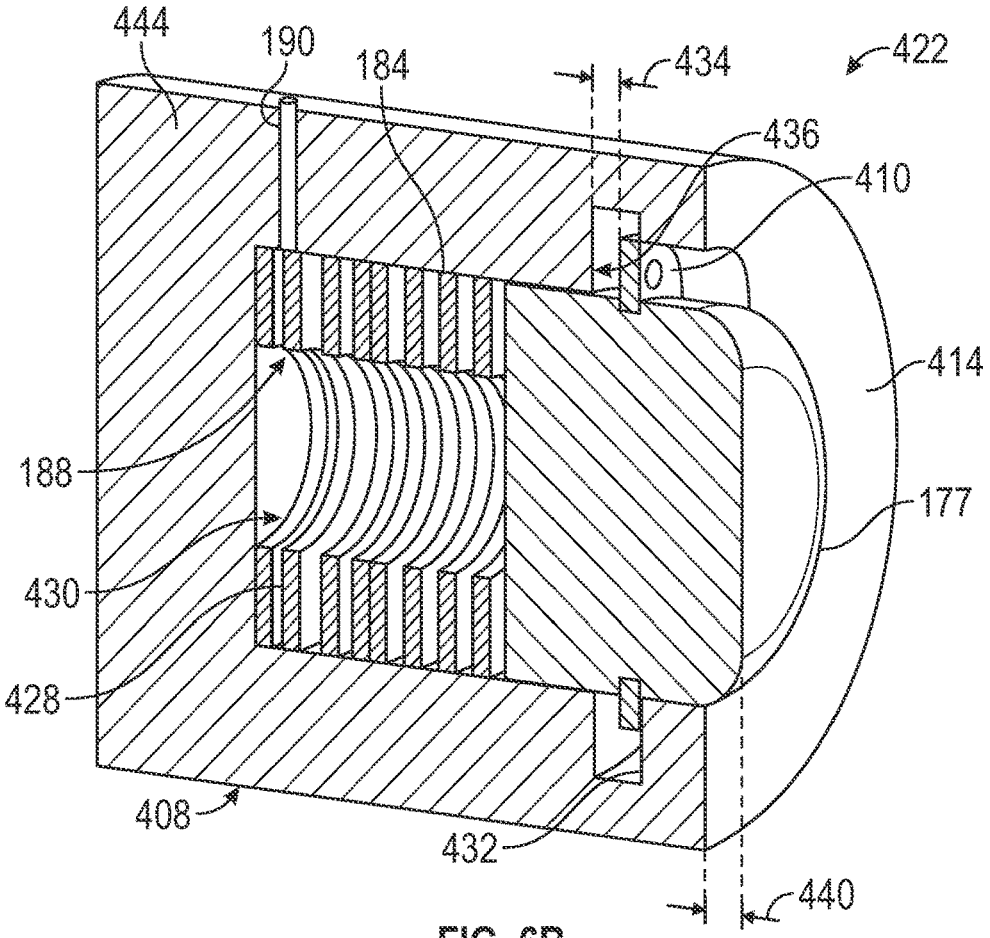
FIG. 6B is a cross-sectional perspective view of the gauge pad subassembly of FIG. 6A illustrating the gauge element biased to an extended configuration by a biasing mechanism constructed as stack of Belville springs.

FIG. 6B is a cross-sectional perspective view of the gauge pad subassembly 422 illustrating the movable gauge element 177 biased to an extended configuration by biasing mechanism 184. As indicated above, the biasing mechanism 184 may include any number of mechanisms including a pressurized fluid, resilient members such as coiled compression springs, elastomeric springs, leaf springs, etc. As illustrated, biasing mechanism 184 is constructed as stack of Belville springs 428. The Belville springs 428 are disposed within a cavity 430 defined in the cylinder 408. The number and orientation of the Belville springs 428 may be varied to provide various engagement forces to the gauge element 177. For example, in some embodiments, non-resilient spacers (not shown) may be substituted for some of the Belville springs 428 such that a relatively low engagement force may be provided.

The Belville springs 428 bias the movable gauge element 177 toward the forward end 414 of the cylinder 408, and the retaining ring 410 engages an inwardly-facing surface 432 of the cylinder 408 to retain the movable gauge element 177 within the cylinder 408. A gap 434 defined between the retaining ring 410 and an outwardly-facing surface 436 of the cylinder 408 defines a radial distance that the movable gauge element 177 is permitted to move within the cavity 430. The gap 434 may be greater than a distance 440 that the face 180 of the movable gauge element 177 protrudes from the forward end 414 of the cylinder, or other circumferential engagement surface 178 of a gauge pad 111 (FIG. 2). Thus, the movable gauge element 177 may move into the cavity 430 against the bias of the Belville springs 428 at least until the face 180 of the movable gauge element 177 is flush with the forward end 414 of the cylinder 408.

The bleed passageway 190 may extend through at least one sidewall 444 of the cylinder 408 to permit fluid to bleed into and out of the fluid chamber 188. The sidewall of the cylinder 408 is generally circular, but in other embodiments, the cylinder 408 may exhibit other geometries such as rectangular.

Figure 7:
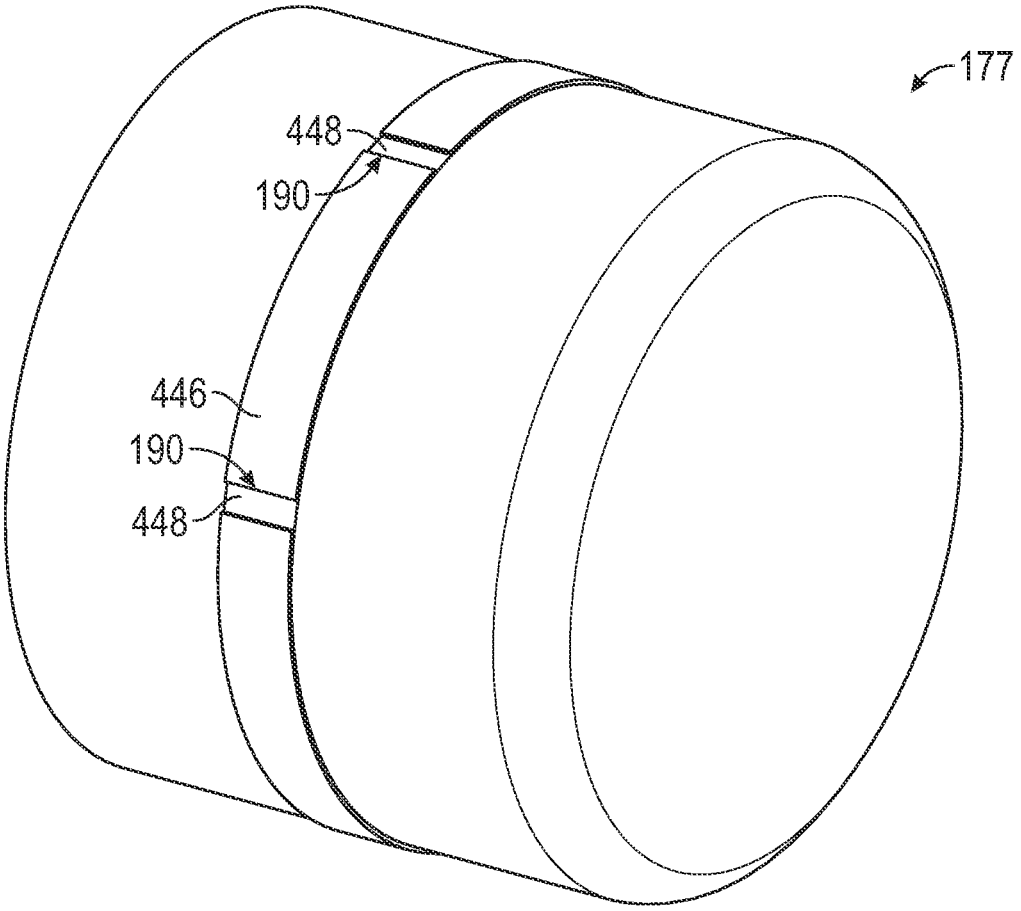
FIG. 7 is a perspective view of a the gauge element of FIG. 6A illustrating a wiper seal having slots therein that permit a small amount of fluid to pass around the gauge element during retraction and extension.

FIG. 7 is a perspective view of the gauge element 177 illustrating a wiper seal 446 disposed around a circumference thereof. The wiper seal 446 may be constructed of elastomeric or metallic materials for forming a sealing engagement with an interior surface of the cylinder 408 (FIG. 6B), e.g., within the fluid chamber 188. The wiper seal 446 includes slots 448 therein that permit a small amount of fluid to pass around the gauge element 177 during retraction and extension. Thus, the slots 448 extending radially along side surfaces of the movable gauge element 177 supplement or constitute a bleed passageway 190. When the gauge elements 177 include slots 448 therein, construction of the drill bit 101 (FIG. 2) may be facilitated since the bleed passageway 190 may be incorporated into the gauge element subassembly 422 (FIG. 6A) which may be prefabricated and coupled to the bit body 124 (FIG. 2).

The aspects of the disclosure described below are provided to describe a selection of concepts in a simplified form that are described in greater detail above. This section is not intended to identify key features or essential features of the claimed subject matter, nor is it intended to be used as an aid in determining the scope of the claimed subject matter.

In one aspect, the disclosure is directed to a drill bit for forming a wellbore through a geologic formation. The drill bit includes a bit body defining a leading end, a trailing end and a rotational bit axis extending between the leading end and the trailing end. At least one gauge pad is defined on the bit body, and the at least one gauge pad defines a circumferential engagement surface thereon. At least one movable gauge element extends through the engagement surface. The movable gauge element is movable between an extended position wherein the movable gauge element protrudes from the engagement surface by a first radial distance, and a retracted position wherein the gauge element protrudes from the engagement surface by a second radial distance less than the first radial distance. A biasing mechanism is operably coupled to the at least one movable gauge element to bias the at least one movable gauge element to the extended position. A fluid chamber is defined in the bit body to have a variable volume depending on the radial distance the movable gauge element protrudes from the engagement surface, and a bleed passageway extends between the fluid chamber and a fluid compensated chamber defined in the bit body.

In one or more example embodiments, the at least one movable gauge element includes a plurality of movable gauge elements axially spaced from one another along the engagement surface of the gauge pad. Respective fluid chambers associated with each of the movable gauge elements may be fluidly coupled to one another, and respective biasing mechanisms associated with each of the movable gauge elements may provide a decreasing engagement force along an axial direction of the bit body from the leading to trailing end.

In some embodiments, the bleed passageway extends through at least one of the bit body and the at least one movable gauge element. In some embodiments, the bleed passageway includes one or more radial slots defined along radially-extending side surfaces of the at least one movable gauge element. In some embodiments, the drill bit further includes a cylinder coupled to the bit body and defining the fluid chamber therein. The movable gauge element may be movably retained within the cylinder along with the biasing mechanism, and the bleed passageway extends between the fluid chamber and the cylinder.

In one or more embodiments, the drill bit further includes an adjustable valve disposed in the bleed passageway operable to adjust a flow area through the bleed passageway. The valve may include an adjustable orifice or a removable component defining a static orifice therethrough. In some embodiments, the second radial distance is substantially zero such that the at least one movable gauge element is substantially flush with the engagement surface of the gauge pad when in the retracted position.

According to another aspect, the disclosure is directed to a drill bit including a bit body defining a rotational bit axis, a plurality of blades projecting radially outwardly from the rotational bit axis and defining radially outer circumferential surfaces thereon, and a gauge pad defined on radially outer circumferential surfaces of one of the blades. The gauge pad defines a circumferential engagement surface thereon, and a plurality of movable gauge elements extend through the circumferential engagement surface. Each movable gauge element is movable between an extended position wherein the movable gauge element protrudes from the engagement surface by a first radial distance, and movable to a retracted position wherein the gauge element protrudes from the engagement surface by a second radial distance less than the first radial distance. A biasing mechanism is operably coupled to each respective movable gauge element to bias the at respective gauge element least one movable gauge element to the extended position. At least one fluid chamber is defined in the bit body to have a variable volume depending on the radial distance at least one of the gauge elements protrudes from the engagement surface. At least one bleed passageway extends between the fluid chamber and a pressure compensated chamber defined in the bit body.

In some embodiments, the biasing mechanism provides a decreasing engagement force to each of the movable gauge elements along an axial direction of the bit body from a leading end to a trailing end of the bit body. The bleed passageway may extend through the bit body to an upper surface of the blade, and a spring rate of each of each resilient member decreases along the axial direction of the bit body.

In one or more example embodiments, the movable gauge elements are disposed in pre-assembled gauge element subassemblies, each including a cylinder defining a fluid chamber of the at least one fluid chamber therein. A bleed passageway of the at least one bleed passageway may extend through at least one of a sidewall of the cylinder and a slot defined in a radially-extending side surface the respective movable gauge elements. The biasing mechanism may include a resilient member disposed within the fluid chamber of each of the gauge element subassemblies.

According to another aspect, the disclosure is directed to a method of drilling a wellbore with a drill bit. The method includes (a) conveying the drill bit into a wellbore on a drill string, (b) engaging a sidewall of the wellbore with a movable gauge element biased to an extended position with respect to a bit body of the drill bit with a biasing mechanism, (c) applying a steering force to the drill bit through the drill string, thereby causing the movable gauge element to move to a retracted position in the bit body, (d) bleeding fluid from a fluid chamber defined in the bit body that changes volume in response to the movement of the movable gauge element to the retracted position, (e) disengaging the sidewall with the movable gauge element such that the biasing mechanism moves the movable gauge element to the extended position, and (f) bleeding fluid into the fluid chamber as in response to the movement of the movable gauge element to the extended position to thereby restrict the movement the movable gauge element to the extended position.

In one or more embodiments, the method further includes rotating the drill bit in the wellbore to engage the movable gauge element on a first side of the wellbore in a steering direction and to disengage the movable gauge element from the sidewall of the wellbore on a second side of the wellbore opposite the steering direction. The method may further include rotating the drill bit at a rate sufficient to maintain the movable gauge element in the retracted position when the movable gauge element is disengaged from the sidewall of the wellbore.

In some embodiments, the method further includes engaging the sidewall with a plurality of movable gauge elements including a first one of the movable gauge elements at a first axial distance from a leading end of the bit body and a second one of the movable gauge elements at a second axial distance from a leading end of the bit body greater than the first axial distance. The method may further include engaging the sidewall with a first radial engagement force with the first one of the movable gauge elements and with a second radial engagement force less than the first radial engagement force with the second one of the movable gauge elements.

The Abstract of the disclosure is solely for providing the United States Patent and Trademark Office and the public at large with a way by which to determine quickly from a cursory reading the nature and gist of technical disclosure, and it represents solely one or more examples.

While various examples have been illustrated in detail, the disclosure is not limited to the examples shown. Modifications and adaptations of the above examples may occur to those skilled in the art. Such modifications and adaptations are in the scope of the disclosure.

What is claimed is:

1. A drill bit, comprising:

a bit body defining a leading end, a trailing end and a rotational bit axis extending between the leading end and the trailing end;

at least one gauge pad defined on the bit body, the at least one gauge pad defining a circumferential engagement surface thereon;

a plurality of movable gauge elements axially spaced from one another along the engagement surface and extending through the engagement surface, each movable gauge element of the plurality of movable gauge elements movable between an extended position wherein the movable gauge element protrudes from the engagement surface by a first radial distance and a retracted position wherein the gauge element protrudes from the engagement surface by a second radial distance less than the first radial distance;

a plurality of biasing mechanisms including a respective biasing mechanism operably coupled to each movable gauge element to bias the movable gauge element to the extended position, the plurality of biasing mechanisms providing a greater engagement force to movable gauge elements less distant from the leading end of the bit body than movable gauge elements more distant from the leading end of the bit body;

a fluid chamber defined in the bit body to have a variable volume depending on the radial distance the movable gauge element protrudes from the engagement surface; and a bleed passageway extending between the fluid chamber and a pressure compensated chamber defined in the bit body.

2. The drill bit according to claim 1, wherein respective fluid chambers associated with each of the movable gauge elements are fluidly coupled to one another.

3. The drill bit according to claim 1, wherein the bleed passageway extends through at least one of the bit body and the at least one movable gauge element.

4. The drill bit according to claim 3, wherein the bleed passageway includes one or more radial slots defined along radially-extending side surfaces of the at least one movable gauge element.

5. The drill bit according to claim 4, further comprising a cylinder coupled to the bit body and defining the fluid chamber therein, wherein the movable gauge element is movably retained within the cylinder along with the biasing mechanism, and wherein the bleed passageway extends between the fluid chamber and the cylinder.

6. The drill bit according to claim 1, further comprising an adjustable valve disposed in the bleed passageway operable to adjust a flow area through the bleed passageway, wherein the valve comprises an adjustable orifice or a removable component defining a static orifice therethrough.

7. The drill bit according to claim 1, wherein the second radial distance is substantially zero such that the at least one movable gauge element is substantially flush with the engagement surface of the gauge pad when in the retracted position.

8. The drill bit according to claim 1, wherein the engagement surface is a stepped engagement surface with a first step extending a first radial distance from the rotational but axis and a second step extending a second radial distance from the rotational bit axis.

9. The drill bit according to claim 8, wherein first radial distance is greater than the second radial distance and wherein the second step is disposed at a greater axial distance from the leading end than the first step.

10. The drill bit according to claim 9, wherein a first set of movable gauge elements of the plurality of movable gauge elements extend through the first step and second set of movable gauge elements of the plurality of movable gauge elements extend through the second step.

11. The drill bit according to claim 10, wherein outer radial faces of the first and second set of movable gauge elements are aligned along an axis generally parallel to the rotational bit axis.

12. A drill bit, comprising:

a bit body defining a rotational bit axis;

a plurality of blades projecting radially outwardly from the rotational bit axis and defining radially outer circumferential surfaces thereon;

a gauge pad defined on radially outer circumferential surfaces of one of the blades, the gauge pad defining a circumferential engagement surface thereon;

a plurality of movable gauge elements axially spaced from one another along the engagement surface and extending through the circumferential engagement surface and each movable between an extended position wherein the movable gauge element protrudes from the engagement surface by a first radial distance, and movable to a retracted position wherein the gauge element protrudes from the engagement surface by a second radial distance less than the first radial distance;

a plurality of biasing mechanism mechanisms including a respective biasing mechanism operably coupled to each respective movable gauge element to bias the at respective gauge element least one movable gauge element to the extended position, the plurality of biasing mechanisms providing a greater engagement force to movable gauge elements less distant from the leading end of the bit body than movable gauge elements more distant from the leading end of the bit body;

at least one fluid chamber defined in the bit body to have a variable volume depending on the radial distance at least one of the gauge elements protrudes from the engagement surface; and at least one bleed passageway extending between the fluid chamber and a pressure compensated chamber defined in the bit body.

13. The drill bit according to claim 12, wherein the plurality of biasing mechanisms include a plurality of resilient members operably coupled to respective gauge elements, wherein the resilient members provide a decreasing engagement force to each of the respective movable gauge elements along an axial direction of the bit body from the leading end to the trailing end of the bit body.

14. The drill bit according to claim 13, wherein the bleed passageway extends through the bit body to an upper surface of the blade.

15. The drill bit according to claim 12, wherein the movable gauge elements are disposed in pre-assembled gauge element subassemblies, each including a cylinder defining a fluid chamber of the at least one fluid chamber therein.

16. The drill bit according to claim 15, wherein a bleed passageway of the at least one bleed passageway extends through at least one of a sidewall of the cylinder and a slot defined in a radially-extending side surface the respective movable gauge elements.

17. The drill bit according to claim 15, wherein the biasing mechanism comprises a resilient member disposed within the fluid chamber of each of the gauge element subassemblies.

18. A method of drilling a wellbore with a drill bit, the method comprising:

conveying the drill bit into a wellbore on a drill string, the drill bit defining a leading end, a trailing end and a rotational bit axis extending therebetween, the drill bit including at least one gauge pad defining a circumferential engagement surface thereon and a plurality of movable gauge elements axially spaced from one another along the engagement surface and biased by a respective biasing mechanism of a plurality of biasing mechanisms:

providing a greater biasing force with the respective biasing mechanisms to movable gauge elements less distant from the leading end of the bit body than gauge elements more distant from the leading end of the bit body;

engaging a sidewall of the wellbore with Hall the plurality of movable gauge elements with a greater engagement force applied by the gauge elements less distant from the leading end of the bit body and a lesser engagement force applied by the gauge elements more distant from the leading end of the bit body;

applying a steering force to the drill bit through the drill string, thereby causing the movable gauge element to move to a retracted position in the bit body;

bleeding fluid from a fluid chamber defined in the bit body that changes volume in response to the movement of the movable gauge element to the retracted position;

disengaging the sidewall with the movable gauge element such that the biasing mechanism moves the movable gauge element to the extended position; and bleeding fluid into the fluid chamber as in response to the movement of the movable gauge element to the extended position to thereby restrict the movement the movable gauge element to the extended position.

19. The method of claim 18, further comprising rotating the drill bit in the wellbore to engage the plurality of movable gauge elements on a first side of the wellbore in a steering direction and to disengage the plurality of movable gauge elements from the sidewall of the wellbore on a second side of the wellbore opposite the steering direction.

20. The method of claim 19, further comprising rotating the drill bit at a rate sufficient to maintain the movable gauge elements in the retracted positions when the movable gauge elements are disengaged from the sidewall of the wellbore.

* * * * *